US006410871B1

(12) United States Patent
Rarbach

(10) Patent No.: US 6,410,871 B1
(45) Date of Patent: Jun. 25, 2002

(54) RETRACTABLE ROTARY KNOB FOR SWITCH INCLUDING LATCH MECHANISM

(75) Inventor: Rainer Rarbach, Nidderau-Eichen (DE)

(73) Assignee: Mannesmann VDO AG (DE)

( * ) Notice: Subject to any disclaimer, the term of this patent is extended or adjusted under 35 U.S.C. 154(b) by 53 days.

(21) Appl. No.: 09/595,408

(22) Filed: Jun. 16, 2000

(30) Foreign Application Priority Data

Jun. 19, 1999 (DE) ..... 199 28 229

(51) Int. Cl.[7] ..... G05G 1/08; H01H 3/02
(52) U.S. Cl. ..... 200/336; 200/566
(58) Field of Search ..... 200/520–525, 200/564, 566, 318–327, 336

(56) References Cited

U.S. PATENT DOCUMENTS 3,557,637 A * 1/1971 Tomczak ..... 74/553
3,997,749 A * 12/1976 Hanagan ..... 200/321
4,642,432 A * 2/1987 Ring ..... 200/336 X
4,733,035 A * 3/1988 Ohashi ..... 200/568
5,384,442 A * 1/1995 Danner ..... 200/566
5,576,525 A * 11/1996 Umemura ..... 200/539

FOREIGN PATENT DOCUMENTS

| | | |
|---|---|---|
| DE | 467127 | 10/1928 |
| DE | 3028379 A | 2/1982 |
| DE | 34 27 378 A1 | 7/1984 |
| DE | 42 30 160 A1 | 9/1992 |
| EP | 0173820 A | 3/1986 |
| EP | 0586825 A | 3/1994 |

* cited by examiner

*Primary Examiner*—J. R. Scott
(74) *Attorney, Agent, or Firm*—David M. Thimmig; Mayer, Brown, Rowe & Maw

(57) ABSTRACT

A simplified retractable knob in which an actuating element can be displaced axially with respect to a bearing element with or counter to the force of a coiled spring. A latching element is integrated into the coil spring, which is guided in a guideway having at least a rest position and an actuating position of the actuating element.

10 Claims, 2 Drawing Sheets

RETRACTABLE ROTARY KNOB FOR SWITCH INCLUDING LATCH MECHANISM

BACKGROUND OF THE INVENTION

The invention relates to a rotary knob which can be retracted in a control unit, having a bearing element and an actuating element which can be displaced axially in the bearing element, the bearing element and the actuating element being connected to each other via a spring element for exerting an axial force on the actuating element, and the bearing element having a guideway with two end positions for a latching element, which end positions are essentially arranged axially one behind the other and determine an actuating position and a rest position, offset axially with respect to the actuating position, of the actuating element.

A retractable rotary knob of this type is disclosed, for example, in DE 34 27 378 A1 and in DE 42 30 160 A1.

Retractable rotary knobs are used for adjusting switching or regulating devices arranged behind a switch panel. Retractable rotary knobs of this type are used in particular in domestic appliances, for example ovens or washing machines. In the normal actuating position, the actuating element of the rotary knob protrudes beyond the control unit's surface, so that rotation of the actuating element enables the desired settings to be carried out. Exerting an axial pressure on the actuating element causes the latter to be pushed into the control unit counter to the force of a spring element. As this happens, a latching element runs through a guideway and latches in an end position which determines the rest position of the actuating element. In the rest position, the actuating element essentially ends at the surface of the control unit. In order to avoid mechanical wear of the latching element against the guideway, in DE 34 27 378 A1 it is proposed to support the latching element in a movable manner and to press it into the guideway by means of a further spring element.

During assembly of the known, retractable rotary knobs, the bearing element, the actuating element, the spring element and the resiliently mounted latching element have to be joined together. The latching element in particular is a small part making its handling difficult during installation. The object of the invention is therefore to specify a retractable rotary knob which has a simplified structure and can be assembled from the component parts in a particularly simple manner.

SUMMARY OF THE INVENTION

In the case of a rotary knob of the generic type, the object is achieved by the latching element being integrated in the spring element. This refinement according to the invention of a retractable rotary knob means that the separate insertion of the latching element is therefore no longer applicable. The latching element and the spring element are designed as one part, thereby simplifying the installation. The spring element is, in particular, designed as a coiled spring. In a preferred embodiment, that end of the coiled spring which is connected to the actuating element is bent over in the axial direction into the interior of the coiled spring and subsequently is bent over approximately at right angles with respect to the axis of the spring element, in order to realize the latching element. To connect the spring element to the actuating element in a simple manner, provision is made for the actuating element to have a guide groove into which that end of the coiled spring which acts as the latching element can be introduced in a simple manner.

In addition to the known application in domestic appliances, the rotary knob according to the invention can, in particular, also be used in motor-vehicle control units. To this end, the rotary knob is connected to a rotary regulator, for example. Preferred spheres of application in a motor vehicle are control elements of a motor-vehicle air-conditioning unit and, in particular in this case, a control element for temperature control. Since a control element of this type is not needed continuously, the design as a retractable rotary knob would be especially relevant here. In the rest position, the retractable rotary knob is then protected against damage. At the same time, the control knob also satisfies aesthetic requirements. A further sphere of application in a motor vehicle is the use of the rotary knob as a control element of audio equipment, in particular of a radio.

BRIEF DESCRIPTION OF THE DRAWINGS

The invention is explained in greater detail below with reference to an exemplary preferred embodiment and to the drawings, in which.

DETAILED DESCRIPTION OF THE PREFERRED EMBODIMENT

Figure 1:
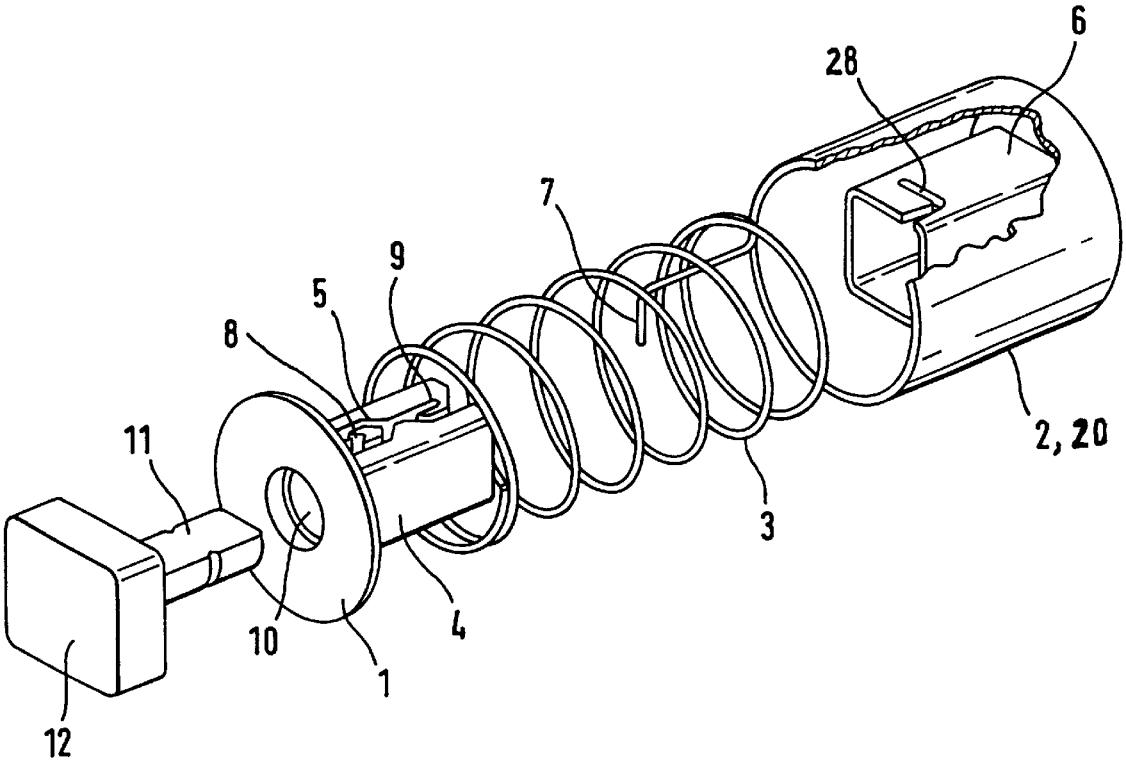
FIG. 1 shows the knob according to the invention.

FIG. 1 illustrates a retractable rotary knob according to the invention. The rotary knob consists of a bearing element 1 and an actuating element 2 which are connected to each other via a coiled spring 3. The bearing element 1 has a cuboidal inner part 4 with a guideway 5 which, in a known manner, is partially of heart-shaped design. The actuating element 2 has an inner part 6 which is designed as a hollow cube and is open on that side which faces the bearing element 1. The internal dimensions of the inner part, 6 are matched to the external dimensions of the inner part 4 of the bearing element 1, so that the actuating element 2 is guided in the bearing element 1. The coiled spring 3 is designed in such a manner that that end of the coiled spring 3 which is connected to the actuating element 2 is bent over in the axial direction into the interior of the coiled spring 3 and subsequently is bent over approximately at right angles with respect to the axis of the coiled spring, in order to realize a latching element 7.

In order to obtain a secure fastening of the coiled spring 3 to the actuating element 2, the actuating element 2 has, in the region of the inner part 6, a guide groove 28 which is initially formed in the axial direction and then at right angles thereto. The latching element 7 can be introduced into the guide groove 28 in a simple manner and remains in the region arranged perpendicularly with respect to the axial direction. A secure connection between the coiled spring 3 and the actuating element 2 is therefore realized. The latching element 7 can then be introduced into the guideway 5 of the bearing element 1.

By means of axial pressure on the actuating or control element 2, 20, the coiled spring 3 is compressed and the latching element 7 is brought through the guideway 5 into the latching position 8. This latching position 8 also serves as the rest position of the actuating element 2, 20. By means of renewed and brief axial pressure on the actuating element 2, 20, the latching element leaves the rest position 8 and is transferred into the end position 9 by the spring force of the coiled spring 3 and the guideway 5. The end position 9 corresponds to the actuating position of the actuating element 2, 20. In the installed state, the actuating element 2, 20 protrudes in this position beyond the surface of a control unit, such as seen in actuating position 20*a* of FIG. 3, and can therefore be actuated.

The bearing element 1 has a non-round socket 10 for the likewise non-round spindle 11 of a regulating element 12. Therefore, in the actuating position of the actuating element 2, rotation of the actuating element 2 can cause the spindle 4 of the rotary regulator 12 to be rotated via the bearing element 1, so that the desired settings are carried out.

Figure 2:
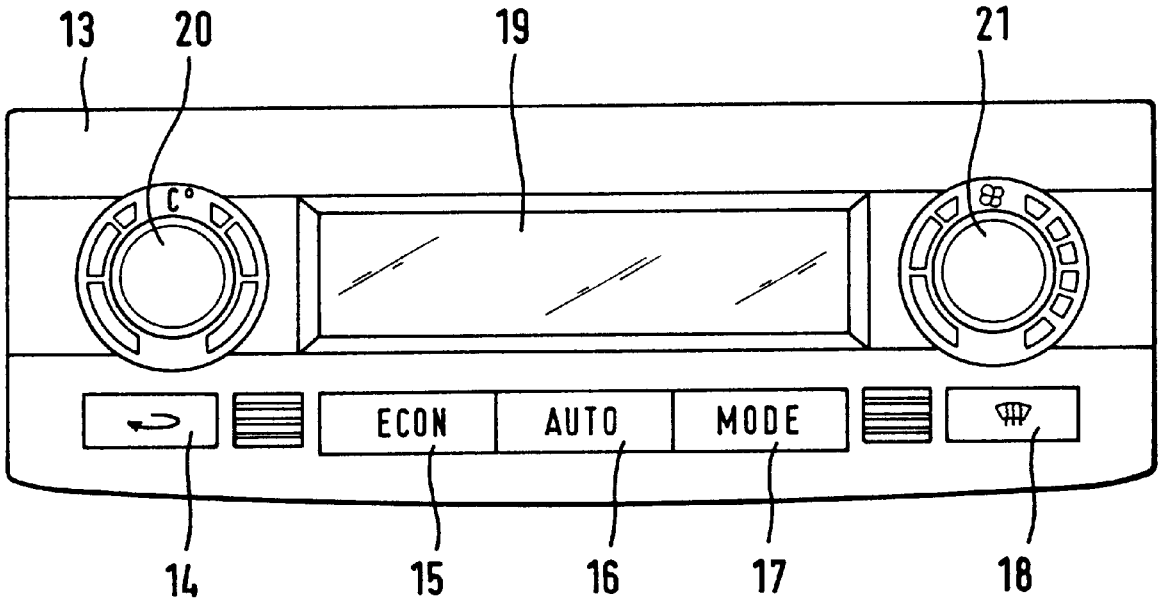
FIG. 2 shows a front view of a control unit with retractable knobs according to the invention.
Figure 3:
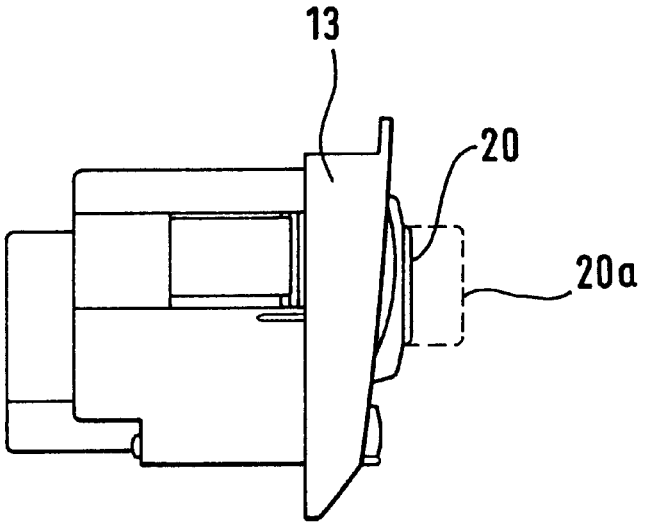
FIG. 3 shows a left side view of the control unit of FIG. 2 with retractable knob 20 according to the invention.

FIG. 2 illustrates a front view and FIG. 3 a left side view of a control unit for a motor-vehicle air-conditioning unit. The control unit 13 has control elements 14 to 18. For example, it can be switched to circulating-air mode via the control element 14, and a particularly economical operating state can be selected via the control element 15. An automatic operating state can be set via the control element 16, or via the control element 17, by repeated pressing, one of various other operating states can be selected.

I claim:

1. A rotary knob which can be retracted in a control unit, the knob comprising a bearing element and an actuating element which can be displaced axially in the bearing element, the bearing element and the actuating element being connected to each other via a spring element for exerting an axial force on the actuating element, and the bearing element having a guideway with two end positions for a latching element, which end positions are essentially arranged axially one behind the other and determine an actuating position and a rest position, offset axially with respect to the actuating position, of the actuating element, wherein the latching element is integrated in the spring element.

2. The retractable rotary knob as claimed in claim 1, wherein the spring element is a coiled spring.

3. The retractable rotary knob as claimed in claim 2, wherein the coiled spring is connected to the actuating element at a first end which is bent over in the axial direction into the interior of the coiled spring and subsequently is bent over approximately at right angles with respect to the axis of the coiled spring to form the latching element.

4. The retractable rotary knob as claimed in claim 1, wherein the actuating element has a guide groove for the latching element.

5. The retractable rotary knob as claimed in claim 1, wherein the rotary knob is part of a rotary regulator of a motor-vehicle control part.

6. The retractable rotary knob as claimed in claim 5, wherein the rotary knob is a control element of audio equipment.

7. The retractable rotary knob as claimed in claim 5, wherein the rotary knob is a control element of a motor-vehicle air-conditioning unit.

8. The retractable rotary knob as claimed in claim 7, wherein it is a control element for a climate control.

9. The retractable knob as claimed in claim 2, wherein the knob also has a rotary control function.

10. The retractable knob as claimed in claim 3, wherein the knob also has a rotary control function.

* * * * *

UNITED STATES PATENT AND TRADEMARK OFFICE

CERTIFICATE OF CORRECTION

PATENT NO. : 6,410,871 B1
DATED : June 25, 2002
INVENTOR(S) : Rainer Rarbach

It is certified that error appears in the above-identified patent and that said Letters Patent is hereby corrected as shown below:

Column 3,
Line 19, insert the following paragraph:

-- The control unit furthermore has a display 19 whose indicating means inform the driver of the operating states selected. There are also two retractable knobs 20, 21 via which the interior temperature or the power of a blower motor can be selected. The knobs 20, 21 are the retractable knobs according to the invention. In the side view, likewise illustrated in Figure 3, of the control unit, the two possible positions of the control element 20 are illustrated. In the rest position, the control element 20 is essentially retracted into the control unit 13. In contrast, in the actuating position 20a, which is illustrated by dashed lines, the control element protrudes out of the surface of the control unit 13, so that the desired settings can be carried out, in this embodiment, by rotating the control element 20. --

Line 20, "rotary" should be deleted.
Line 21, -- a depressible -- should be substituted for "an".

Column 4,
Lines 1, 3 and 10, "rotary" should be deleted.
Line 11, "retaining a portion of -- should be inserted after "guide groove for".
Lines 13 and 14, "rotary" should be deleted in both instances.
Lines 16 and 17, "rotary" should be deleted in both instances.
Lines 20 and 21, "rotary" should be deleted in both instances.
Lines 23 and 24, "rotary" should be deleted.
Line 23, -- knob -- should be substituted for "it".

Signed and Sealed this

Fifteenth Day of April, 2003

JAMES E. ROGAN
*Director of the United States Patent and Trademark Office*